United States Patent [19]

Rheinländer

[11] Patent Number: 5,058,705

[45] Date of Patent: Oct. 22, 1991

[54] SOUND-ABSORBING COVER ELEMENT AS A COMPONENT IN A GAP-FREE ACOUSTIC COVER

[75] Inventor: Heinz Rheinländer, Wiesenweg, Fed. Rep. of Germany

[73] Assignee: Sto AG, Stuhlingen, Fed. Rep. of Germany

[21] Appl. No.: 280,376

[22] Filed: Dec. 6, 1988

[30] Foreign Application Priority Data

Dec. 16, 1987 [DE] Fed. Rep. of Germany ... 8716596[U]

[51] Int. Cl.[5] ..... E04B 1/343

[52] U.S. Cl. ..... 181/287; 181/288; 181/291; 428/131; 428/134; 428/137; 428/138; 428/284; 428/285; 428/703

[58] Field of Search ..... 181/287, 288, 291; 428/131, 137, 135, 284, 285, 134, 703

[56] References Cited

U.S. PATENT DOCUMENTS

| | | | |
|---|---|---|---|
| 4,219,376 | 8/1980 | Roman | 428/138 |
| 4,657,610 | 4/1987 | Komatsu et al. | 428/137 |
| 4,917,933 | 4/1990 | Schluter | 428/137 |

FOREIGN PATENT DOCUMENTS

| | | |
|---|---|---|
| 87052709.9 | 8/1987 | Fed. Rep. of Germany . |
| A01238674 | 10/1959 | France . |

*Primary Examiner*—James J. Bell

*Attorney, Agent, or Firm*—Fleit, Jacobson, Cohn, Price, Holman & Stern

[57] ABSTRACT

A sound-absorbing cover element for use as a component in a gap-free acoustic cover including a perforated plate (22) covered on its side facing an enclosed space with a layer (24) of nonwoven fiber material which covers the perforations. The plate is lined on its side facing away from the enclosed space with a sound-inhibiting layer (28) covered on its side facing away from the perforated plate (22) with a cover film (30) which is impermeable to air.

15 Claims, 1 Drawing Sheet

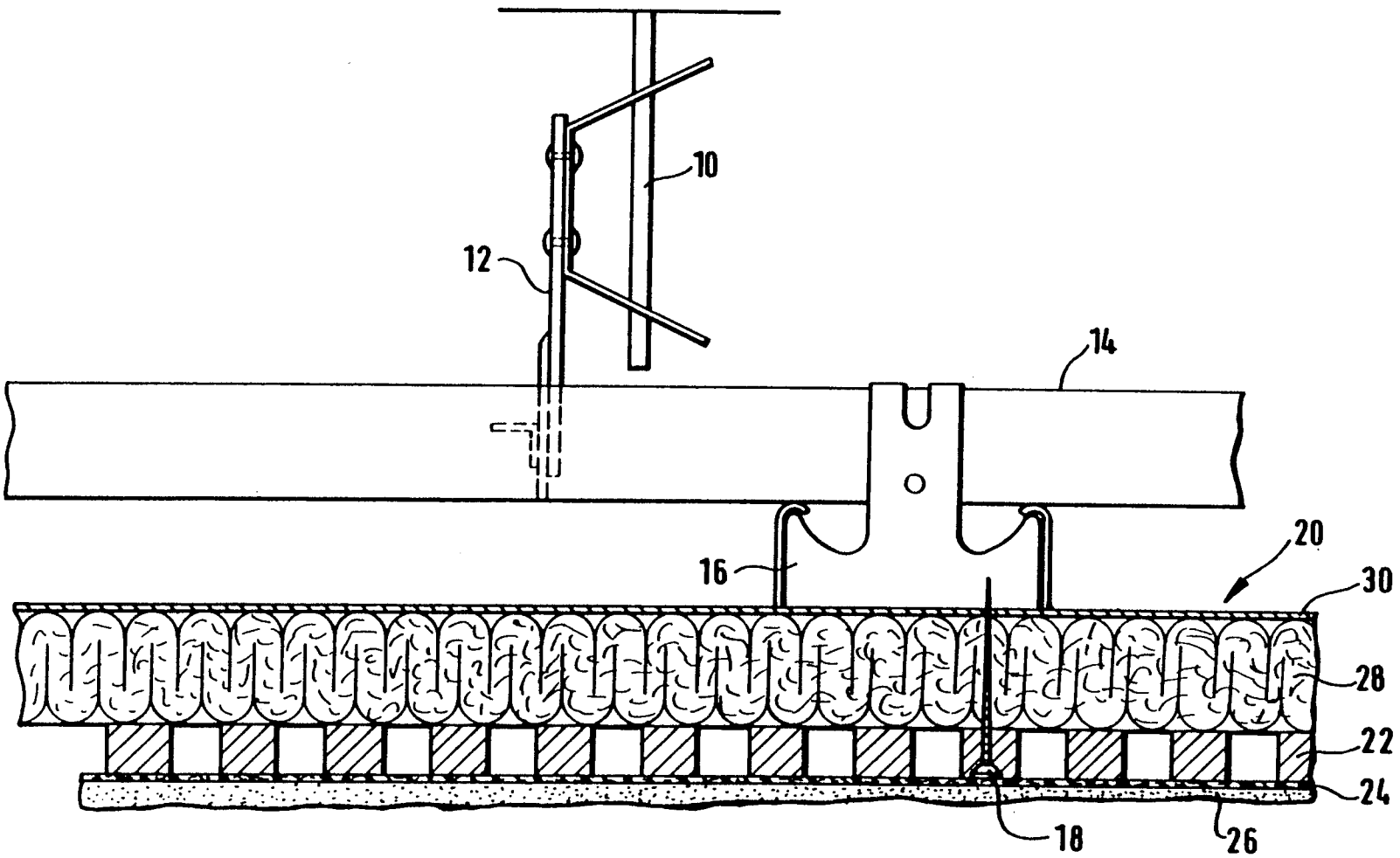
10
12
14
16
18
20
22
24
26
28
30

SOUND-ABSORBING COVER ELEMENT AS A COMPONENT IN A GAP-FREE ACOUSTIC COVER

BACKGROUND OF THE INVENTION

The invention relates to sound-absorbing acoustic covers, and more particularly, to cover elements for use as a component in a gap-free acoustic cover comprised of a perforated plate covered on a side facing an enclosed space with a layer of nonwoven fiber material covering perforations of the plate, and a sound-inhibiting layer lining the side of the plate facing away from the enclosed space.

Known structural configurations for sound-absorption are used particularly for acoustic covers suspended under the ceilings of rooms. The sound waves pass from the room through the sound-permeable layer of plaster or the like, and into the perforations of the perforated plate, and are sharply attenuated in the sound-inhibiting layer disposed behind said plate. An acoustic cover comprised of such cover elements has outstanding acoustic properties.

It has been found in practice however, that such covers act as a type of dirt filter. When heated air circulates through the cover, or forced air in air conditioned rooms, dirt particles carried along in the circulating air are concentrated in the region of the perforations and are filtered out by the plaster layer. This causes a noticeable and unattractive soiling of the loci of the plaster layer which are located in front of and which cover the perforations.

This effect is accentuated if installation workers take shortcuts and fail to apply the inhibiting layer immediately behind the perforated plate, which requires cutting the inhibiting layer to size, due to the presence of the supporting profile members which are spaced at regular intervals. The workers may elect to merely apply the inhibiting layer over the base profile members instead of in the rectangular spaces between them, so that a substantial void space exists between the perforated plate and the inhibiting layer, thereby facilitating air circulation and accelerating the soiling of the plaster layers.

BRIEF SUMMARY OF THE INVENTION

The object of the invention is to avoid the soiling of the plaster layer caused by the filtration effect, and to compel proper positioning of the sound inhibiting layer. The above and other problems are solved with a sound-absorbing cover element for use as a component in a gap-free acoustic cover. The cover element has a perforated plate covered on its side facing an enclosed space such as a room, with a layer of nonwoven fiber material covering the perforations. The plate is lined on its side facing away from the enclosed space with a sound-inhibiting layer that is covered on its side facing away from the perforated plate by a cover film which is impermeable to air.

It is seen that a sandwiched plate is produced which is pre-assembled from the individual layers, which layers are namely the perforated plate with a nonwoven fiber layer and a plaster layer on one side and inhibiting layer and impermeable cover film on the other side. This pre-assembly ensures the proper mutual positioning of the parts. In particular, it ensures that the inhibiting layer is positioned directly on the perforated plate. The flow resistance of the inhibiting layer thus positioned ensures reduction of air circulation. The chief feature whereby the air circulation is blocked, however, is the additional, air impermeable cover film which is applied as the cover layer on the side facing away from the room. This film prevents movement of air through the acoustic cover into the space thereabove, which space is created by the suspension of the cover. This blocking of air circulation, and the additional flow resistance provided by the sound-inhibiting layer disposed above the perforations of the perforated plate combine to minimize air movement in the cover element, whereby undesired soiling of the plaster layer in the region of the perforations of the perforated plate will no longer occur.

BRIEF DESCRIPTION OF THE DRAWING

All features in the drawing not expressly referred to hereinbelow are incorporated herein by reference, for the purpose of disclosing the essential features of the invention. The drawing is a cross-sectional view of part of an exemplary embodiment of the invention.

DETAILED DESCRIPTION OF THE INVENTION

Referring now to the drawing, the top end (not shown) of a mounting fitting for the cover is attached to the principal cover member of the enclosed space (i.e., true ceiling members of the room), which space (hereinafter referred to as the "room") is to be provided with a suspended acoustic cover. The base profile 14 of the mounting fitting is attached to the fitting element 10 via an anchor element 12. This base profile 14 extends over the entire cover and allows the sound-absorbing cover elements to be suspended via anchor wedges 16 in known fashion, so that at the top of said wedges 16 they can be suspended to extend over (and possiblY beyond) the extent of the base profile 14, and the bottom of wedges 16 are connected to sound-absorbing cover element 20 having a sandwiched plate structure, said connection to element 20 being accomplished by fasteners 18 (shown only schematically).

The cover element 20 is comprised of numerous layers. The supporting element is a perforated plate 22 comprised of gypsum plasterboard. The perforations as illustrated have a regular pattern and structure. They may be regularly distributed over the surface. In practice however, it has been found that the acoustic properties are improved if holes of a variety (i.e., two or more) of sizes are provided in the perforated plate. The thickness of the gypsum plasterboard is preferably between 10 and 15 millimeters. The perforated plate 22 is covered with a layer of nonwoven fiber material 24, preferably made of glass fibers, disposed on the lower surface of plate 22 (that is, the surface facing the room). The layer 24 extends over the perforations and thereby re-forms a closed surface. Over the nonwoven layer 24, the cover element 20 bears a thin layer 26 comprising a plaster-type coating (hereinafter simply referred to as "plaster") which is permeable to sound but impermeable to light. This layer is rigid to the touch. In the region of the butt joints between neighboring cover elements 20, the plaster layer 26 extends solidly so as to be closed and free of gaps, so that overall a closed plaster layer is produced which conceals the perforated character of the cover which is behind it.

On the side of element 20 which faces away from the room, the sandwiched plate which forms element 20 has a sound inhibiting layer 28. This lies immediately on the rear (i.e., upper) side of the perforated plate 22, but is much thicker than plate 22 (at least twice as thick), in order to ensure the sound-absorbing properties of the acoustic cover. The sound inhibiting layer 28 may also be comprised of glass fibers or mineral wool.

A critical feature is that the sandwiched plate which forms the cover element 20 has a covering film 30 as the final layer on its side facing away from the room. This prevents air from circulating through (i.e., traversing) the sandwich plate. Nonetheless, the sound-absorbing property of the cover element is retained. At the same time, effective means of preventing unattractive soiling of the visible side of the cover element 20 is provided.

I claim:

1. A sound absorbing cover element, comprising:

a perforated plate having a first side facing an enclosed space and a second side facing oppositely to said first side;

a layer of nonwoven fiber material covering perforations in said plate and said first side of said plate;

a layer of plaster permeable to sound on the side of said layer of nonwoven material facing the enclosed space;

a sound-inhibiting layer having a first surface lining said second side of said plate and a second surface facing oppositely to said first surface, said sound inhibiting layer being made of material selected from the group consisting of glass fibers and mineral wool; and a cover of film impermeable to air covering said second surface of said sound-inhibiting layer.

2. The sound absorbing cover element as claimed in claim 1, wherein:

said plaster layer comprises a rigid layer impermeable to light.

3. THe sound absorbing cover element as claimed in claim 1, wherein:

said first surface of said sound-inhibiting layer is positioned in direct contacting engagement with said second side of said perforated plate.

4. The sound absorbing cover element as claimed in claim 2, wherein:

said first surface of said sound-inhibiting layer is positioned in direct contacting engagement with said second side of said perforated plate.

5. The sound absorbing cover element as claimed in claim 1, wherein:

said perforated plate is comprised of plasterboard.

6. The sound absorbing cover element as claimed in claim 3, wherein:

said perorations are distributed over said perforated plate in a regular pattern.

7. The sound absorbing cover element as claimed in claim 3, wherein:

said perforations are of a plurality of sizes distributed over said plate.

8. The sound absorbing cover element as claimed in claim 3, wherein:

said sound-inhibiting layer has a thickness not less than twice the thickness of said perforated plate.

9. The sound absorbing cover element as claimed in claim 1, wherein:

said perforated plate, layer of nonwoven fiber material, sound-inhibiting layer and cover of film comprise a pre-assembled sandwich plate with said first surface of said sound-inhibiting layer positioned directly on said second side of said perforated plate;

said sound-inhibiting layer has a thickness not less than twice the thickness of said perforated plate; and said perforations are of a plurality of sizes distributed over said plate.

10. A sound absorbing cover element, comprising:

a sound permeable layer;

a perforated plate having a first side disposed upon said sound permeable layer and a second side facing in a direction opposite to said first side;

a sound-inhibiting layer having a first surface disposed upon said second side of said perforated plate and a second surface facing in a direction opposite to said first surface, said sound inhibiting layer being made of material selected from the group consisting of glass fibers and mineral wool; and a film impermeable to air disposed on and covering said second surface of said sound inhibiting layer;

said sound permeable layer, perforated plate, sound inhibiting layer and film being arranged in a pre-assembled sandwich plate.

11. The sound absorbing cover element as claimed in claim 10, and further comprising:

a rigid layer impermeable to light disposed on a surface of said sound permeable layer.

12. The sound absorbing cover element as claimed in claim 10, wherein:

said first surface of said sound-inhibiting layer is positioned directly on said second side of said perforated plate.

13. The sound absorbing cover element as claimed in claim 11, wherein:

said perforations are distributed over said first side of said perforated plate in a regular pattern.

14. A sound absorbing cover element, comprising:

a perforated plate having a first side separated by a first thickness of said perforated plate from a second side thereof;

means made of a sound-permeable, nonwoven fiber disposed on said first side, for covering and forming a closed surface over perforations in said perforated plate;

intermediate means having a first surface disposed on said second side, a second surface separated by a second thickness from said first surface, said second thickness being not less than twice the first thickness of said perforated plate, for inhibiting transmission of sound and for limiting circulation of air between said perforated plate and intermediate means, said intermediate means comprising material selected from the group consisting of glass fibers and mineral wool; and means disposed on said second surface, for restricting passage of air;

said perforated plate, nonwoven fiber covering means, intermediate means, and restricting means being arranged in a moveable, pre-assembled, sandwich plate.

15. The sound absorbing cover element as claimed in claim 6, wherein:

said perforations are of a plurality of sizes distributed over said plate.

* * * * *